US010087951B2

(12) United States Patent
Inada et al.

(10) Patent No.: US 10,087,951 B2
(45) Date of Patent: Oct. 2, 2018

(54) FAN CASING AND FAN APPARATUS

(71) Applicant: SANYO DENKI CO., LTD., Tokyo (JP)

(72) Inventors: Naoya Inada, Tokyo (JP); Honami Osawa, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 283 days.

(21) Appl. No.: 14/987,847

(22) Filed: Jan. 5, 2016

(65) Prior Publication Data

US 2016/0201689 A1 Jul. 14, 2016

(30) Foreign Application Priority Data

Jan. 8, 2015 (JP) ..... 2015-002176

(51) Int. Cl.

| | |
|---|---|
| ***F04D 29/54*** | (2006.01) |
| ***F04D 19/00*** | (2006.01) |
| ***F04D 25/08*** | (2006.01) |
| ***F04D 29/32*** | (2006.01) |
| ***F04D 29/52*** | (2006.01) |
| ***F04D 29/64*** | (2006.01) |
| ***F04D 25/06*** | (2006.01) |

(52) U.S. Cl.

CPC ..... *F04D 29/542* (2013.01); *F04D 19/002* (2013.01); *F04D 25/0613* (2013.01); *F04D 25/08* (2013.01); *F04D 29/325* (2013.01); *F04D 29/522* (2013.01); *F04D 29/547* (2013.01); *F04D 29/644* (2013.01); *F04D 29/545* (2013.01)

(58) Field of Classification Search

CPC .... F04D 29/542; F04D 29/544; F04D 29/644; F04D 29/522; F04D 19/002; F04D 29/545; F04D 29/547; F04D 25/0613; F04D 25/08

USPC ..... 415/207, 211.2, 220; 417/354

See application file for complete search history.

(56) References Cited

U.S. PATENT DOCUMENTS

2005/0186070 A1 8/2005 Buckley
2009/0257869 A1* 10/2009 Li ..... F04D 25/0613 415/220

(Continued)

FOREIGN PATENT DOCUMENTS

CN 203978934 U * 12/2014 ..... F04D 29/542
JP 5133398 A2 5/1993

(Continued)

*Primary Examiner* — Christopher Verdier

(74) *Attorney, Agent, or Firm* — Rankin, Hill & Clark LLP

(57) ABSTRACT

A fan casing includes: an air duct communicating with an air inlet and outlet; a frame body forming an outer peripheral surface of the air duct; a hub portion forming an inner peripheral surface of the air duct on the outlet side; and a stator blade portion provided in the air duct, the stator blade portion coupling the frame body to the hub portion. The hub portion includes a cylindrical-shaped cylindrical portion and a tapered portion provided next to the cylindrical portion and provided in such a manner as to increase the width of the air duct toward the outlet. The stator blade portion couples the cylindrical portion to the frame body.

8 Claims, 5 Drawing Sheets

(56) References Cited

U.S. PATENT DOCUMENTS

| | | | | |
|---|---|---|---|---|
| 2012/0093635 | A1* | 4/2012 | Yoshida | F04D 25/0613<br>415/191 |
| 2015/0064029 | A1* | 3/2015 | Higuchi | F04D 29/542<br>417/354 |

FOREIGN PATENT DOCUMENTS

| | | | |
|---|---|---|---|
| JP | 3083969 | | 2/2002 |
| WO | 2005081979 | A2 | 9/2005 |

* cited by examiner

FAN CASING AND FAN APPARATUS

CROSS-REFERENCE TO RELATED APPLICATION

This application claims priority from Japanese Patent Application No. 2015-002176 filed with the Japan Patent Office on Jan. 8, 2015, the entire content of which is hereby incorporated by reference.

BACKGROUND

1. Technical Field

An embodiment of the present disclosure relates to a fan casing and a fan apparatus including the fan casing.

2. Description of the Related Art

In recent years, what is called an axial fan apparatus such as described in JP-A-05-133398 has been widely used as a cooling fan of an electronic apparatus such as a server. The axial fan apparatus rotates rotor blade portions pivotally supported by a motor in an air duct of a fan casing to blow air through the air duct.

SUMMARY

A fan casing includes: an air duct communicating with an air inlet and outlet; a frame body forming an outer peripheral surface of the air duct; a hub portion forming an inner peripheral surface of the air duct on the outlet side; and a stator blade portion provided in the air duct, the stator blade portion coupling the frame body to the hub portion. The hub portion includes a cylindrical-shaped cylindrical portion and a tapered portion provided next o the cylindrical portion and provided in such a manner as to increase the width of the air duct toward the outlet. The stator blade portion couples the cylindrical portion to the frame body.

DESCRIPTION OF EMBODIMENT

Figure 1:
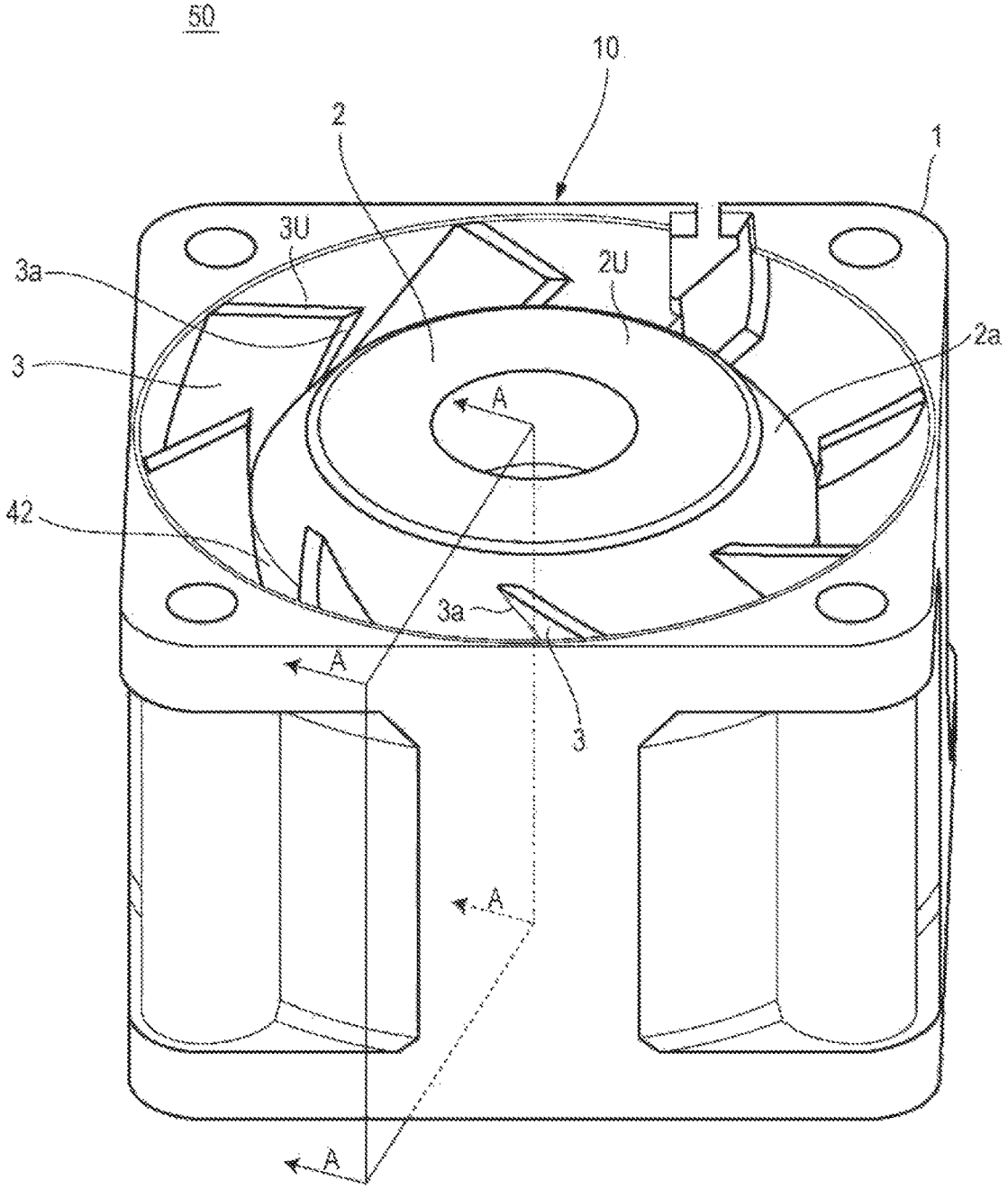
FIG. 1 is a perspective view of a fan apparatus according to one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Improving performance of the air flow has been proposed in a known fan apparatus. There is a case where the size of an air duct of a fan casing is restricted by a drive component such as a motor, and the performance of the motor or the like is constant. In this case, it is not easy to improve the performance of the air flow beyond the restrictions on the size of the air duct of the fan casing and the like.

In order to improve the performance of the air flow of the fan apparatus here, the static pressure in the air duct of the fan casing is also considered. Generally, the fan apparatus has air flow-static pressure characteristics where the static pressure is reduced with increasing air flow. Such a fan apparatus is required to increase the air flow at a static pressure of approximately zero and improve the performance of the air flow of when the static pressure is acting.

One object of the present disclosure is to provide a fan casing and a fan apparatus that have high performance of the air flow.

A fan casing according to one embodiment of the present disclosure (the fan casing) includes: an air duct communicating with an air inlet and outlet; a frame body forming an outer peripheral surface of the air duct; a hub portion forming an inner peripheral surface of the air duct on the outlet side; and a stator blade portion provided in the air duct, the stator blade portion coupling the frame body to the hub portion. The hub portion includes a cylindrical-shaped cylindrical portion and a tapered portion provided next to the cylindrical portion and provided in such a manner as to increase the width of the air duct toward the outlet. The stator blade portion couples the cylindrical portion to the frame body.

The tapered portion may be inclined toward a central axis of the cylindrical portion, or may have an arc shape.

The stator blade portion may extend toward the outlet beyond a coupled part between the stator blade portion and the cylindrical portion, and may be placed around the tapered portion, spaced from the tapered portion.

A fan apparatus according to one embodiment of the present disclosure includes: the fan casing; a motor; and a rotor blade portion pivotally supported by the motor, and rotated by drive of the motor to blow air through the air duct.

According to the embodiment of the preset disclosure, the performance of the air flow against static pressure can be improved.

Figure 2:
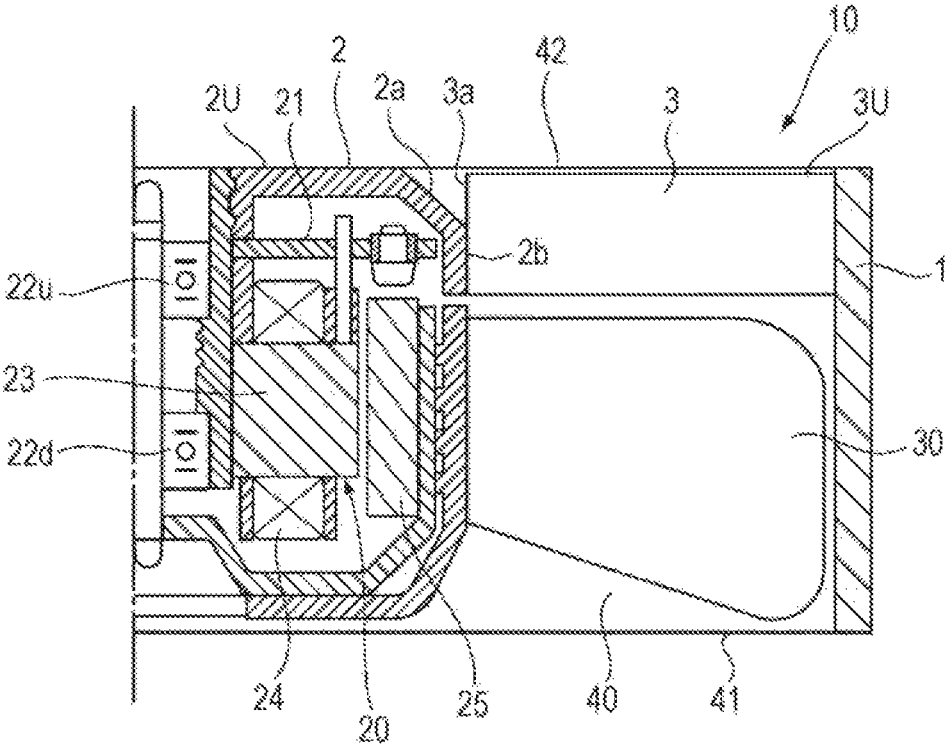
FIG. 2 is a cross-sectional explanatory view illustrating across section A in FIG. 1 of the fan apparatus illustrated in FIG. 1.

One embodiment of the present disclosure is described hereinafter. FIG. 1 is a perspective view of a fan apparatus 50 being an axial fan. FIG. 2 is a cross-sectional explanatory view illustrating across section A in FIG. 1.

The fan apparatus 50 at least includes a motor 20, rotor blade portions 30 for blowing air, and a fan casing 10 surrounding the motor 20 and the rotor blade portions 30.

The fan casing 10 includes an air duct 40. The air duct 40 communicates with an air inlet 41 and outlet 42. The fan casing 10 includes a frame body 1, a hub portion 2, and eight stator blade portions 3. The frame body 1 forms outer peripheral surface of the air duct 40. The hub portion 2 forms an inner peripheral surface of the air duct 40 on the outlet side. The stator blade portions 3 couple the frame body 1 to the hub portion 2.

In the embodiment, the fan casing 10 includes eight stator blade portions 3. However, the number of the stator blade portions 3 is not limited to eight, and may be equal to or more than mine or equal to or less than seven.

The hub portion 2 is configured including a cylindrical-shaped cylindrical portion 2*b* on the inlet 41 side while including a tapered portion 2*a* on the outlet 42 side.

The tapered portion 2*a* is coupled to (is provided next to) the cylindrical portion 2*b*. As illustrated in FIG. 2, the tapered portion 2*a* is provided in such a manner as to increase the width of the air duct 40 toward the outlet 42. In other words, the tapered portion 2*a* is configured in such a manner as to be inclined toward a central axis of the hub portion 2.

In the embodiment, the tapered portion 2*a* has a linear slope. Instead of this, the tapered portion 2*a* may be configured having a curved slope or an arc shape.

The stator blade portions 3 are configured in such a manner as to be coupled to the frame body 1 at the cylindrical portion 2*b* on the inlet 41 side. In other words, the stator blade portions 3 couple the cylindrical portion 2*b* of the hub portion 2 to the frame body 1. The stator blade portions 3 are not coupled to the tapered portion 2*a* on the outlet 42 side. In other words, the stator blade portions 3 are configured in such a manner as to avoid coupling to the tapered portion 2*a* of the hub portion 2. The stator blade portions 3 extend toward the outlet 42 beyond the parts coupled to the cylindrical portion 2*b*, and are placed around the tapered portion 2*a*, spaced from the tapered portion 2*a*.

Moreover, the cross section A illustrated in FIG. 1 is perpendicular to the central axis of the hub portion 2 and the rotation direction of the rotor blade portion 30. The stator blade portion 3 has a shape inclined in a curved fashion (for example, an arc shape) with respect to the cross section A.

In the embodiment, the stator blade portion 3 is inclined in a curved fashion with respect to the cross section A. Instead of this, the stator blade portion 3 may be formed in such a manner as to be linearly inclined with respect to the cross section A. Alternatively, the stator blade portion 3 may be formed in such a manner as to have a linear shape (for example, a flat-plate shape) parallel to the cross section A. Furthermore, the stator blade portion 3 may be formed in such a manner as to have a spiral shape with respect to the central axis of the hub portion 2. Especially, the shape of the stator blade portion 3 can be changed in design in accordance with the shape of the rotor blade portion 30, as appropriate.

Moreover, as illustrated in FIG. 2, a stator blade upper surface portion 3U of the stator blade portion 3 on the outlet 42 side is placed at a position lower by approximately several millimeters than a hub upper surface portion 2U of the hub portion 2 on the outlet 42 side. In the embodiment, the stator blade upper surface portion 3U is placed at the position lower by approximately several millimeters than the hub upper surface portion 2U. Instead of this, the stator blade upper surface portion 3U and the hub upper surface portion 2U may be placed at positions at substantially the same height.

When the tapered portion is provided to the hub portion, the stator blade portions owe typically coupled also to the tapered portion to pull out a mold from the inlet side. Therefore, it is difficult to cause the stator blade portions and the tapered portion to be spaced apart.

According to the shape of the fan casing 10 in the embodiment, the stator blade portions 3 can be spaced from the tapered portion 2*a* by removing all parts that cannot be molded. The removal of all the parts that cannot be molded enables the vertical pull-out of two molds, a first mold on the inlet 41 side and a second mold on the outlet 42 side. As a result, the fan casing 10 in the embodiment can be produced very easily.

As illustrated in FIG. 2, the motor 20 is provided inside the hub portion 2. The motor 20 (the fan apparatus 50) includes a circuit board that controls the motor 20, bearings 22*u* and 22*d*, a stat 23, a coil 24 wound around the stator 23, and a rotor 25.

In the embodiment, the fan apparatus 50 is configured including the circuit board 21. Instead of this, the fan apparatus 50 may not include the circuit board 21.

The rotor 25 is connected to the rotatable rotor blade portions 30. When the motor 20 is driven, the rotor blade portions 30 are rotated to take in air from the inlet 41 side, The air taken in is blown toward the outlet 42. In other words, the motor 20 supports the rotor blade portions 30 pivotally. The motor 20 is driven to rotate the rotor blade portions 30. Air is then blown through the air duct 40.

The number of the rotor blade portions 30 is seven that is less by one than the eight stator blade portions 3. The number of the rotor blade portions 30 is not limited to seven, but may be equal to or more than eight, or equal to or less than six. However, the number of the rotor blade portions 30 is desired to be less than the number of the stator blade portions 3.

Next, the relationship between air flow and static pressure in the fan apparatus 50 according to the embodiment is described.

Figure 3:
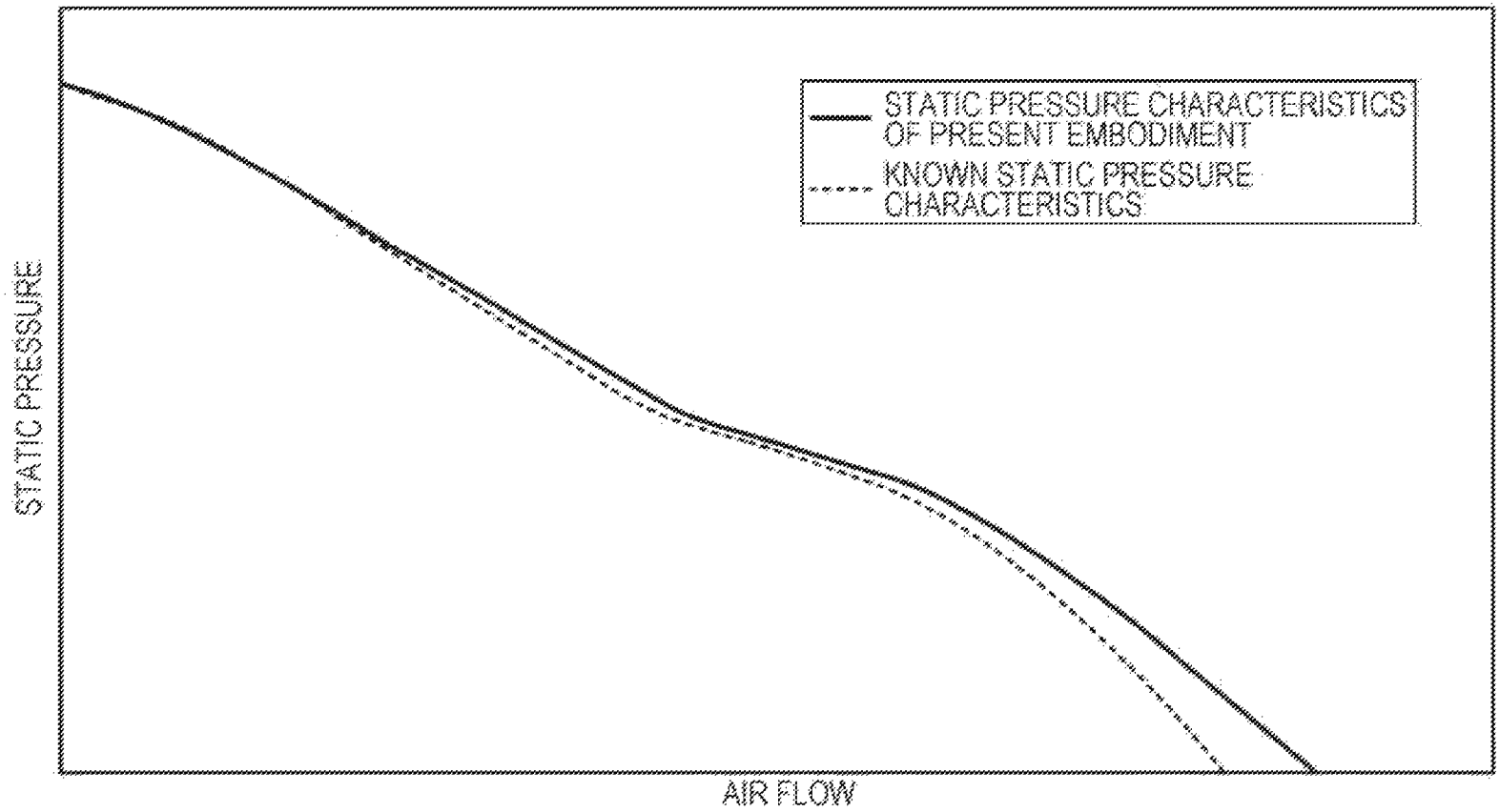
FIG. 3 is a diagram illustrating the relationships between air flow and static pressure in the fan apparatus according to the present disclosure and known fan apparatus.
Figure 4:
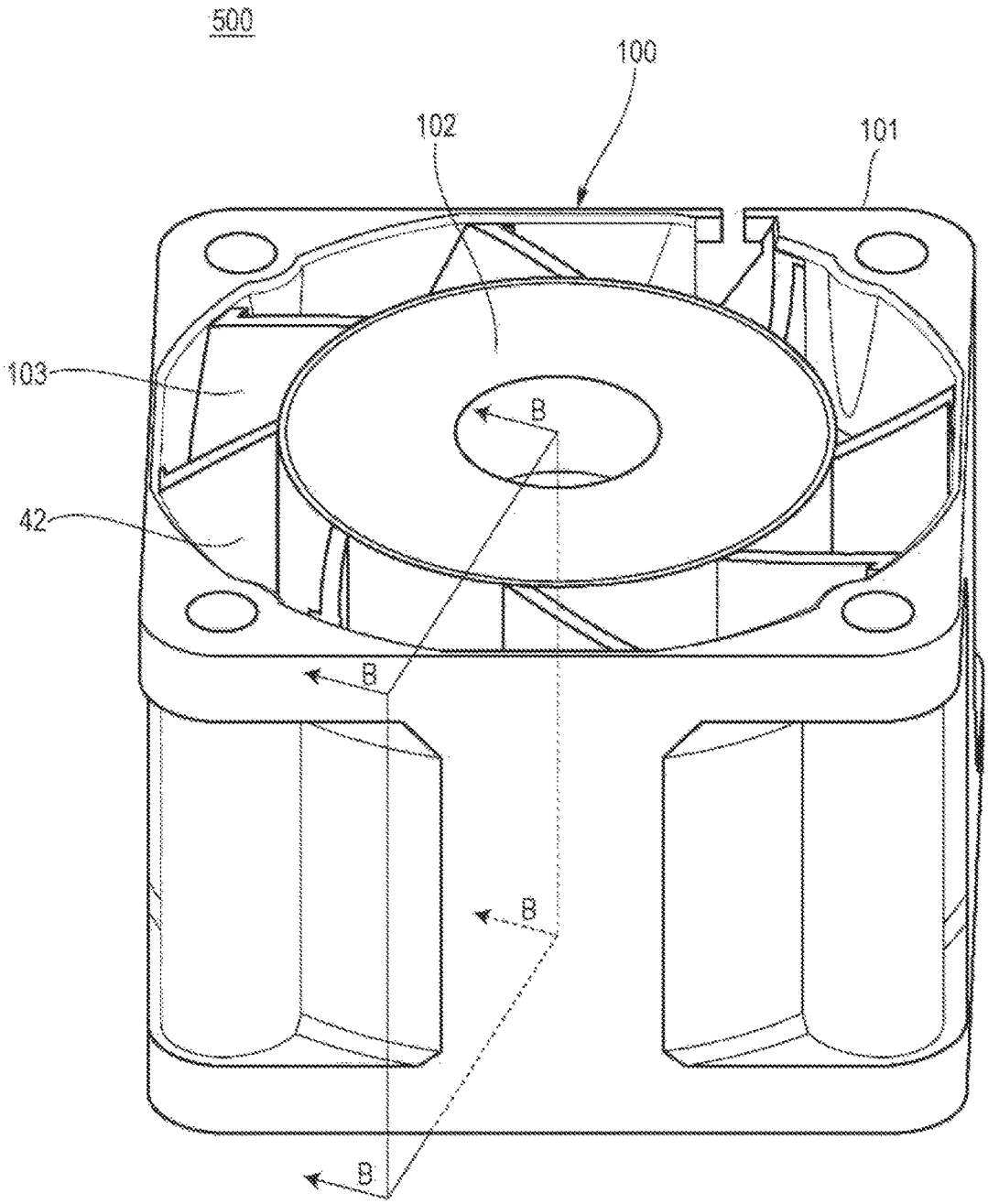
FIG. 4 is a perspective view of the known fan apparatus.

FIG. 3 is a diagram illustrating the relationships between air flow and static pressure in the fan apparatus 50 according to the present embodiment and a known fan apparatus 500 (see FIG. 4). In the relationship diagram between air flow and static pressure illustrated in FIG. 3, the vertical axis indicates static pressure, and the horizontal axis indicates air flow. Furthermore, a solid line indicates air flow-static pressure characteristics of the fan apparatus 50 in the embodiment. A dotted line indicates air flow-static pressure characteristics of the known fan apparatus 500.

Figure 5:
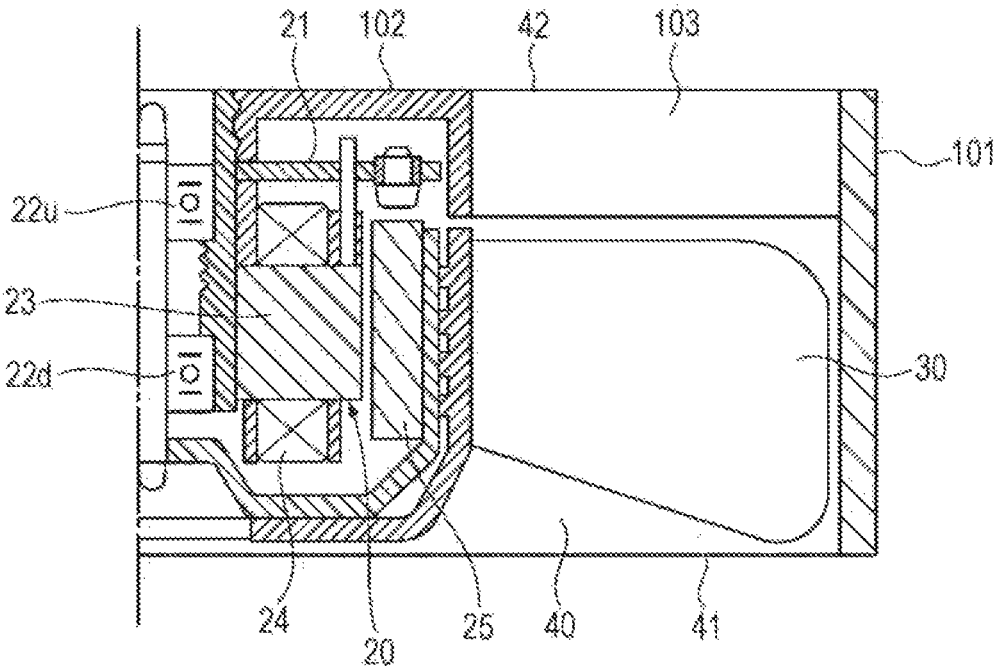
FIG. 5 is a cross-sectional explanatory view illustrating across section B in FIG. 4 of the known fan apparatus.

The known fan apparatus 500 is briefly described using FIGS. 4 and 5. FIG. 4 is a perspective view of the known fan apparatus 500. FIG. 5 is a cross-sectional explanatory view illustrating across section B in FIG. 4. The same reference numerals as those in FIGS. 1 and 2 are assigned to the same portions as those of the fan apparatus 50 of the embodiment. Their descriptions are omitted.

The known fan apparatus 500 at least includes the motor 20, the rotor blade portions 30, and a fan casing 100 surrounding the motor 20 and the rotor blade portions 30. Moreover, the known fan casing 100 includes a frame body 101, a hub portion 102, and eight stator blade portions 103 that couple the frame body 101 to the hub portion 102.

In the known fan apparatus 500, the hub portion 2 has a cylindrical shape and does not have a tapered portion on the outlet 42 side unlike the fan apparatus 50 according to the embodiment.

Thus, in the known fan apparatus 500, the hub portion 102 is formed such that an entire side surface of the hub portion 102 is perpendicular to upper surface of the hub portion 102, as illustrated in FIG. 5. As is clear from a comparison of FIGS. 2 and 5, a substantially triangular space in cross-sectional view, which has two sides, the tapered portion 2*a* and a stator blade cross section 3*a*, and is illustrated in FIG. 2, is not formed in the known fan apparatus 500.

When the known fan apparatus 500 such as described above is compared with the fan apparatus 50 of the embodiment, it can be seen from the illustration of FIG. 3 that the fan apparatus 50 of the embodiment has higher performance of the air flow against static pressure. Especially, there is a clear difference in maximum air flow. In the fan apparatus 50 of the embodiment, the maximum air flow is improved approximately 10% as compared to the known fan apparatus 500.

In this manner, the fan apparatus 50 of the embodiment has higher performance of the air flow against static pressure than the known fan apparatus 500, One of the reasons is that the hub portion 2 includes the tapered portion 2*a* and accordingly, it is possible to ensure a large width of the air duct 40 on the outlet 42 side and to direct the flow of the air blown from the rotor blade portions 30 toward the center.

Furthermore, in the fan apparatus 50 of the embodiment, the height of the stator blade upper surface portion 3U of the stator blade portion 3 is placed close to the height of the hub upper surface portion 2U of the hub portion 2. Consequently, it is possible to rectify the air blown from the rotor blade portions 30. This is also the reason that the fan apparatus 50 of the embodiment has higher performance of the air flow against static pressure than the known fan apparatus 500.

Moreover, as described above, the fan apparatus 50 of the embodiment has the substantially triangular space in cross-sectional view, which has two sides, the tapered portion 2*a* and the stator blade cross section 3*a*, as illustrated in FIG. 2, Here, if the stator blade portion 3 is coupled to the tapered portion 2*a*, the air flow can be increased more than the known fan apparatus. However, a vortex and the like may occur at the coupled part between the stator blade portion 3 and the tapered portion 2*a*. Therefore, the flow of air may be inhibited to reduce the performance of the air flow against static pressure.

According to the fan apparatus 50 of the embodiment, the substantially triangular space having two sides, the tapered portion 2*a* and the stator blade cross section 3*a*, is formed. Therefore, a vortex and the like hardly occur at the coupled part between the stator blade portion 3 and the tapered portion 2*a*. As a result, the fan apparatus 50 can improve the performance of the air flow against static pressure efficiently.

As described above, the fan apparatus 50 of the embodiment can improve the performance of the air flow against static pressure and obtain suitable air flow-static pressure characteristics.

In the fan apparatus 50 and the fan casing 10 of the embodiment, the stator blade portions 3 are not coupled to the tapered portion 2*a*, and are placed around the tapered portion 2*a*, spaced from the tapered portion 2*a*. Instead of this, the stator blade portions 3 may be configured in such a manner as to be coupled to the tapered portion 2*a* and also be placed around the tapered portion 2*a*. Also in this case, a large width of the air duct 40 on the outlet 42 side can be ensured by the tapered portion 2*a*. Therefore, the air blown from the rotor blade portions 30 can be directed toward the center. As a result, the performance of the air flow can be improved.

Furthermore, in the fan apparatus 50 and the fan casing 10 of the embodiment, the stator blade portions 3 extend toward the outlet 42 beyond the coupled parts between the static blade portions 3 and the cylindrical portion 2*b*. Furthermore, the static blade portions 3 are placed around the tapered portion 2*a*, spaced from the tapered portion 2*a*. Instead of this, the stator blade portions 3 may not extend toward the outlet 42 beyond the coupled parts between the static blade portions 3 and the cylindrical portion 2*b*. In other words, the static blade portions 3 may not be placed around the tapered portion 2*a*. Also in this case, a large width of the air duct 40 on the outlet 42 side can be ensured by the tapered portion 2*a*. Therefore, the air blown from the rotor blade portions 30 can be directed toward the center. As a result, the performance of the air flow can be improved.

In the fan apparatus 50, the substantially triangular portion having the two sides, the tapered portion 2*a* and the stator blade cross section 3*a*, may be formed as illustrated in FIG. 2.

Embodiments of the present disclosure may be the following first and second fan casings, and first fan apparatus.

The first fan casing is a fan casing having an air duct communicating with an air inlet and outlet, and includes a frame body forming an outer peripheral surface of the air duct, a hub portion forming an inner peripheral surface of the air duct on the outlet side, and a stator blade portion provided in the air duct, the stator blade portion coupling the frame body to the hub portion. The hub portion has a cylindrical-shaped cylindrical portion, and a tapered portion coupled to the cylindrical portion and inclined toward a central axis of the cylindrical portion, or formed into an arc shape, to increase the width of the air duct toward the outlet. The stator blade portion is coupled to the frame body at the cylindrical portion.

In the second fan casing according to the first casing, the static blade portion extends toward the outlet beyond a part coupled to the cylindrical portion, and is located around the tapered portion, spaced from the tapered portion.

The first fan apparatus includes a fan casing having an air duct communicating with an air inlet and outlet, a motor, and a rotor blade portion pivotally supported by the motor, the first fan apparatus being configured to blow air through the air duct by the rotor blade portion being rotated by drive of the motor. The fan casing has a frame body forming an outer peripheral surface of the air duct, a hub portion forming an inner peripheral surface of the air duct on the outlet side, and a stator blade portion provided in the air duct to couple the frame body to the hub portion. The hub portion has a cylindrical-shaped cylindrical portion, and a tapered portion coupled to the cylindrical portion and inclined toward a central axis of the cylindrical portion, or formed into an arc shape, to increase the width of the air duct toward the outlet. The stator blade portion is coupled to the frame body at the cylindrical portion.

The first and second fan casings and the first fan apparatus can improve the performance of the air flow against static pressure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A fan casing comprising:

an air duct communicating with an air inlet and outlet;

a frame body forming an outer peripheral surface of the air duct;

a hub portion forming an inner peripheral surface of the air duct on the outlet; and a stator blade portion provided in the air duct, the stator blade portion coupling the frame body to the hub portion, wherein the hub portion includes a cylindrical-shaped cylindrical portion and a tapered portion provided next to the cylindrical portion and provided in such a manner as to increase the width of the air duct toward the outlet, the stator blade portion couples the cylindrical portion to the frame body, an uppermost surface of the stator blade on the outlet is placed at a position lower than an uppermost surface of the hub portion on the outlet, and in a cross-section of the fan casing in a direction parallel with a central axis of the cylindrical portion, a portion of a side surface of the stator blade portion is coupled with a side surface of the cylindrical portion, an entirety of the side surface of the stator blade portion is in parallel with the central axis of the cylindrical portion, and the fan casing has on the outlet a triangular space having two sides comprising the side surface of the stator blade portion and a side surface of the tapered portion.

2. The fan casing according to claim 1, wherein the tapered portion is inclined toward a central axis of the cylindrical portion.

3. The fan casing according to claim 1, wherein the stator blade portion extends toward the outlet beyond a coupled part between the stator blade portion and the cylindrical portion, and is placed around the tapered portion, spaced from the tapered portion.

4. The fan casing according to claim 2, wherein the stator blade portion extends toward the outlet beyond a coupled part between the stator blade portion and the cylindrical portion, and is placed around the tapered portion, spaced from the tapered portion.

5. A fan apparatus comprising:

the fan casing according to claim 1;

a motor; and a rotor blade portion pivotally supported by the motor, and rotated by drive of the motor to blow air through the air duct.

6. A fan apparatus comprising:

the fan casing according to claim 2;

a motor; and a rotor blade portion pivotally supported by the motor, and rotated by drive of the motor to blow air through the air duct.

7. A fan apparatus comprising:

the fan casing according to claim 3;

a motor; and a rotor blade portion pivotally supported by the motor, and rotated by drive of the motor to blow air through the air duct.

8. A fan apparatus comprising:

the fan casing according to claim 4;

a motor; and a rotor blade portion pivotally supported by the motor, and rotated by drive of the motor to blow air through the air duct.

* * * * *